US011485526B2

(12) United States Patent
Boccolari et al.

(10) Patent No.: US 11,485,526 B2
(45) Date of Patent: Nov. 1, 2022

(54) PACKAGING APPARATUS FOR FORMING SEALED PACKAGES

(71) Applicant: TETRA LAVAL HOLDINGS & FINANCE S.A., Pully (CH)

(72) Inventors: Stefano Boccolari, Modena (IT); Paolo Benedetti; Filippo Ferrarini, Modena (IT); Luca Poppi, Formigine (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 213 days.

(21) Appl. No.: 16/640,141

(22) PCT Filed: Sep. 21, 2018

(86) PCT No.: PCT/EP2018/075678
§ 371 (c)(1),
(2) Date: Feb. 19, 2020

(87) PCT Pub. No.: WO2019/063446
PCT Pub. Date: Apr. 4, 2019

(65) Prior Publication Data

US 2021/0155355 A1 May 27, 2021

(30) Foreign Application Priority Data

Sep. 27, 2017 (EP) ..... 17193460

(51) Int. Cl.
*B65B 9/20* (2012.01)
*B65B 9/207* (2012.01)
(Continued)

(52) U.S. Cl.
CPC ..... *B65B 9/207* (2013.01); *B65B 9/12* (2013.01); *B65B 9/2028* (2013.01);
(Continued)

(58) Field of Classification Search
CPC ..... B65B 9/20; B65B 9/207; B65B 9/2028; B65B 9/2049; B65B 55/08; B65B 51/26; B65B 59/04; B65B 41/16
See application file for complete search history.

(56) References Cited

U.S. PATENT DOCUMENTS 1,986,422 A * 1/1935 Zwoyer ..... B65B 9/213 53/131.5
2,934,130 A * 4/1960 Lane ..... B29C 66/133 156/466
(Continued)

FOREIGN PATENT DOCUMENTS

CN 209410396 U 9/2019
WO 0204295 A1 1/2002
(Continued)

OTHER PUBLICATIONS

International Search Report (PCT/ISA/210) dated May 27, 2019, by the European Patent Office as the International Searching Authority for International Application No. PCT/EP2018/075678.
(Continued)

*Primary Examiner* — Andrew M Tecco
(74) *Attorney, Agent, or Firm* — Buchanan Ingersoll & Rooney PC

(57) ABSTRACT

There is described a packaging apparatus for forming a plurality of sealed packages-comprising conveyor for advancing a web of packaging material along an advancement path, an isolation chamber, a tube forming device adapted to form a tube from the, in use, advancing web of packaging material, a sealing device adapted to longitudinally seal the tube, a support structure carrying at least the tube forming device, a filling device for continuously filling the tube formed by the tube forming device, a package forming unit adapted to form and seal the packages from the, in use, advancing tube formed by the tube forming device
(Continued)

and filled by the filling device. The support structure comprises at least one support column at least indirectly carrying the tube forming device and extending parallel to the longitudinal axis of the tube forming device.

20 Claims, 6 Drawing Sheets

(51) Int. Cl.

| | |
|---|---|
| ***B65B 9/12*** | (2006.01) |
| ***B65B 31/02*** | (2006.01) |
| ***B65B 41/16*** | (2006.01) |
| ***B65B 51/26*** | (2006.01) |
| ***B65B 55/08*** | (2006.01) |

(52) U.S. Cl.
CPC ..... *B65B 9/2049* (2013.01); *B65B 31/02* (2013.01); *B65B 41/16* (2013.01); *B65B 51/26* (2013.01); *B65B 55/08* (2013.01)

(56) References Cited

U.S. PATENT DOCUMENTS 3,324,621 A * 6/1967 Runge ..... B65B 9/20 53/138.4
4,848,063 A * 7/1989 Niske ..... B65B 61/24 53/451
6,052,970 A * 4/2000 Fujimoto ..... B65B 9/2042 493/271
6,170,227 B1 * 1/2001 Kovacs ..... B29C 66/8221 53/375.9
6,397,557 B1 * 6/2002 Bassissi ..... B29C 53/54 53/51
6,666,002 B1 * 12/2003 Otsuka ..... B29C 65/7451 53/426
7,827,768 B2 * 11/2010 Rosberg ..... B65B 9/20 53/452
8,707,662 B2 * 4/2014 Borsari ..... B29C 65/3656 53/550
9,637,260 B2 * 5/2017 Ghirardello ..... B65B 55/103
9,745,104 B2 * 8/2017 Sanfilippo ..... B65B 9/22
2001/0047641 A1 * 12/2001 Kume ..... B65B 51/303 53/493
2009/0120828 A1 * 5/2009 Sanfilippo ..... B65D 5/746 206/508
2014/0185962 A1 * 7/2014 Sanfilippo ..... B65D 33/16 383/6
2014/0196407 A1 * 7/2014 Ghirardello ..... B65B 9/20 53/426
2015/0336701 A1 * 11/2015 Eidebakken ..... A61L 2/087 53/426

FOREIGN PATENT DOCUMENTS

WO 2013050203 A1 4/2013
WO 2014066867 A1 5/2014
WO 2019/063446 A2 4/2019

OTHER PUBLICATIONS

Written Opinion (PCT/ISA/237) dated May 27, 2019, by the European Patent Office as the International Searching Authority for International Application No. PCT/EP2018/075678.

* cited by examiner

D
27
66
29
66
30
60
63
64
43
42
43
62
61
65
44
60
63
64
64
41
63
41
H
I
40
64
46
62
41
41
40
48
38
63
M
64
15
47
62
45
63
J
64
41
M
41
56
39
40

PACKAGING APPARATUS FOR FORMING SEALED PACKAGES

TECHNICAL FIELD

The present invention relates to a packaging apparatus for forming sealed packages, in particular for forming sealed packages filled with a pourable product.

BACKGROUND ART

As is known, many liquid or pourable food products, such as fruit juice, UHT (ultra-high-temperature treated) milk, wine, tomato sauce, etc., are sold in packages made of sterilized packaging material.

A typical example is the parallelepiped-shaped package for liquid or pourable food products known as Tetra Erik Aseptic (registered trademark), which is made by sealing and folding laminated strip packaging material. The packaging material has a multilayer structure comprising a base layer, e.g. of paper, covered on both sides with layers of heat-seal plastic material, e.g. polyethylene. In the case of aseptic packages for long-storage products, such as UHT milk, the packaging material also comprises a layer of oxygen-barrier material, e.g. an aluminum foil, which is superimposed on a layer of heat-seal plastic material, and is in turn covered with another layer of heat-seal plastic material forming the inner face of the package eventually contacting the food product.

Packages of this sort are normally produced on fully automatic packaging apparatuses.

A typical packaging apparatus comprises a conveying device for advancing a web of packaging material along an advancement path, a sterilizing unit for sterilizing the web of packaging material, a tube forming device arranged within an aseptic chamber and being adapted to form a tube from the advancing web of packaging material, a sealing device for longitudinally sealing the tube along a seam portion of the tube, a filling device for continuously filling the tube with a pourable product and a package forming unit adapted to produce single packages from the tube of packaging material.

The packaging apparatus comprises a base support structure, typically placed on a plant's floor, and within which the package forming unit is arranged. The aseptic chamber is typically formed from a rigid housing, manufactured as a single piece, mounted onto the base support structure.

The tube forming device comprises a plurality of forming rings and bending rollers mounted to the forming rings so as to gradually form, in use, the tube from the web of packaging material. The forming rings are mounted to an inner side of the rigid housing.

However, as the housing comprises inevitable imperfections as a consequence of its manufacturing process, the forming rings are not aligned with one another according to the required preciseness (i.e. the forming rings are not coaxial with one another). This requires laborious interventions by a technician so as to align the forming rings according to the required preciseness.

Furthermore, the aseptic chamber structure as known requires laborious interventions so as to modify the packaging apparatus for processing a new package type leading to an increased downtime.

Additionally, during a format change it is necessary to precisely align the package forming unit with respect to the tube forming, device so that the package forming unit receives, in use, the tube in the correct manner. The precise alignment is, however, time consuming.

DISCLOSURE OF INVENTION

It is therefore an object of the present invention to provide a packaging apparatus to overcome, in a straightforward and low-cost manner, at least one of the aforementioned drawbacks.

According to the present invention, there is provided a packaging apparatus as claimed in claim 1.

Further advantageous embodiments of the packaging apparatus according to the invention are specified in the dependent claims.

BRIEF DESCRIPTION OF THE DRAWINGS

A non-limiting embodiment of the present invention will be described by way of example with reference to the accompanying drawings, in which.

BEST MODES FOR CARRYING OUT THE INVENTION

Figure 1:
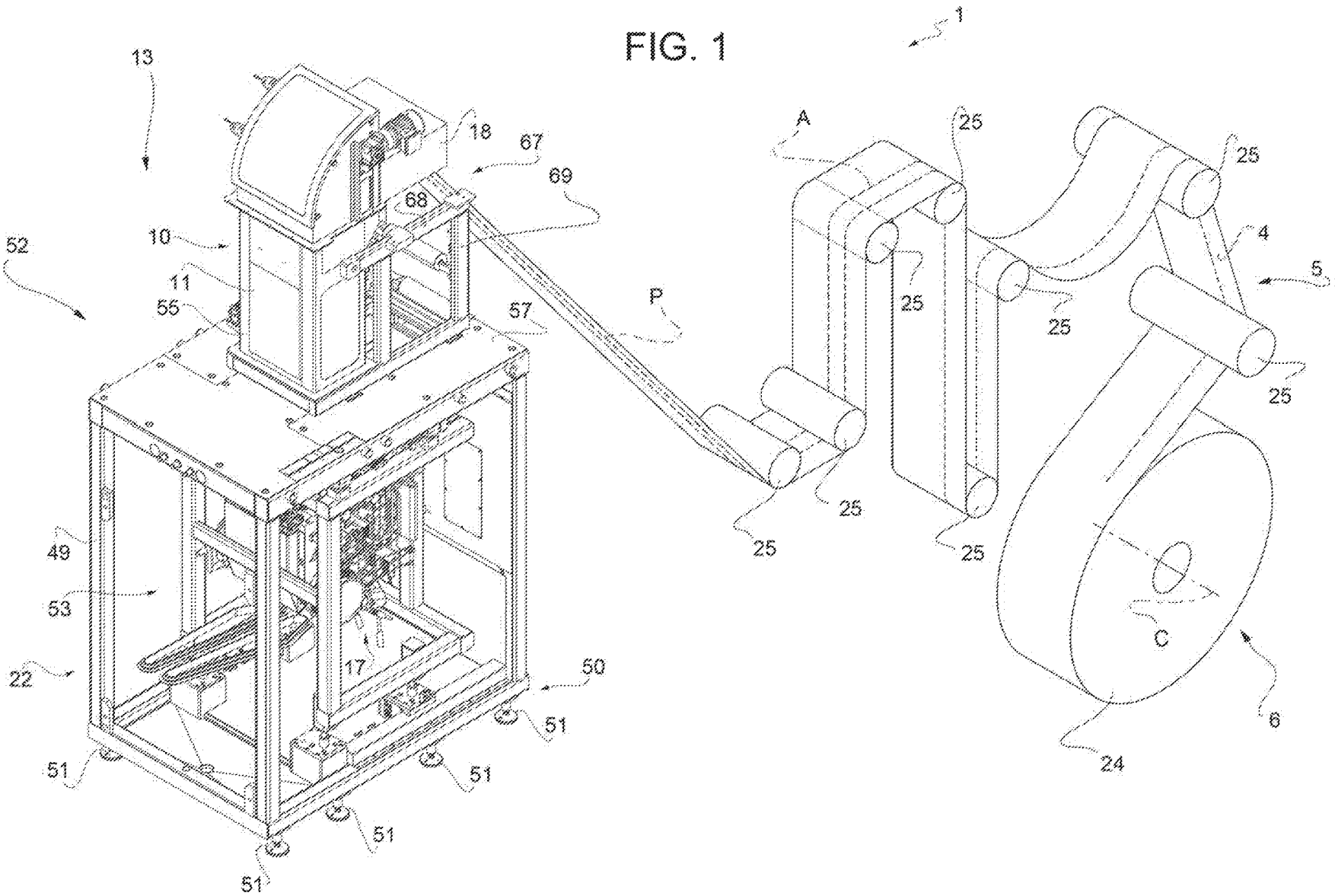
FIG. 1 is a partially perspective and partially schematic view of a packaging apparatus according to the present invention, with parts removed for clarity.

Number 1 indicates as a whole a packaging apparatus for producing sealed packages 2 (only one shown in FIG. 2) of a pourable food product, such as pasteurized milk or fruit juice, from a tube 3 of a web 4 of packaging material.

Web 4 of packaging material has a multilayer structure (not shown), and comprises a layer of fibrous material, normally paper, covered on both sides with respective layers of heat-seal plastic material, e.g. polyethylene.

Preferably, web 4 also comprises a layer of gas- and light-barrier material, e.g. aluminum foil or ethylene vinyl alcohol (EVOH) film, and at least a first and a second layer of heat-seal plastic material. The layer of gas- and light-barrier material is superimposed on the first layer of heat-seal plastic material, and is in turn covered with the second layer of heat-seal plastic material. The second layer of heat-seal plastic material forms the inner face of package 2 eventually contacting the food product.

With particular reference to FIGS. 1 to 4, packaging apparatus 1 comprises:

- conveying means 5 for advancing web 4 along its longitudinal axis A along an advancement path P from a delivery station 6 to a forming station. 7, at which, in use, web 4 is formed into tube 3;

an isolation chamber 10 having a housing 11 separating an inner environment, in particular an inner aseptic environment, from an outer environment 13;

a tube forming device 14 extending along a longitudinal axis L, in particular having a vertical orientation, and being arranged, in particular at station 7, at least partially, preferably fully, within isolation chamber 10 and being adapted to form tube 3 from the, in use, advancing web 4;

a sealing device 15 at least partially arranged within isolation chamber 10 and being adapted to longitudinally seal tube 3 formed by device 14;

filling means 16 for continuously filling tube 3 formed by device 14 with the pourable product; and a package forming unit 17 adapted to transversally seal and form packages 2 from the, in use, advancing tube 3 formed by device 14 and filled by filling means 16.

Preferably, packaging apparatus 1 also comprises a sterilizing unit 18 adapted to sterilize the, in use, advancing web 4 at a sterilization station, in particular the sterilization station being arranged upstream of forming station. 7 along path P.

Preferentially, packaging apparatus 1 also comprises a base support structure 22 housing package forming unit 17 and, preferably, also carrying isolation chamber 10.

Advantageously, packaging apparatus 1 also comprises a support structure 23 carrying at least tube forming device 14. Preferentially, support structure 23 also carries at least a portion of sealing device 15.

Figure 2:
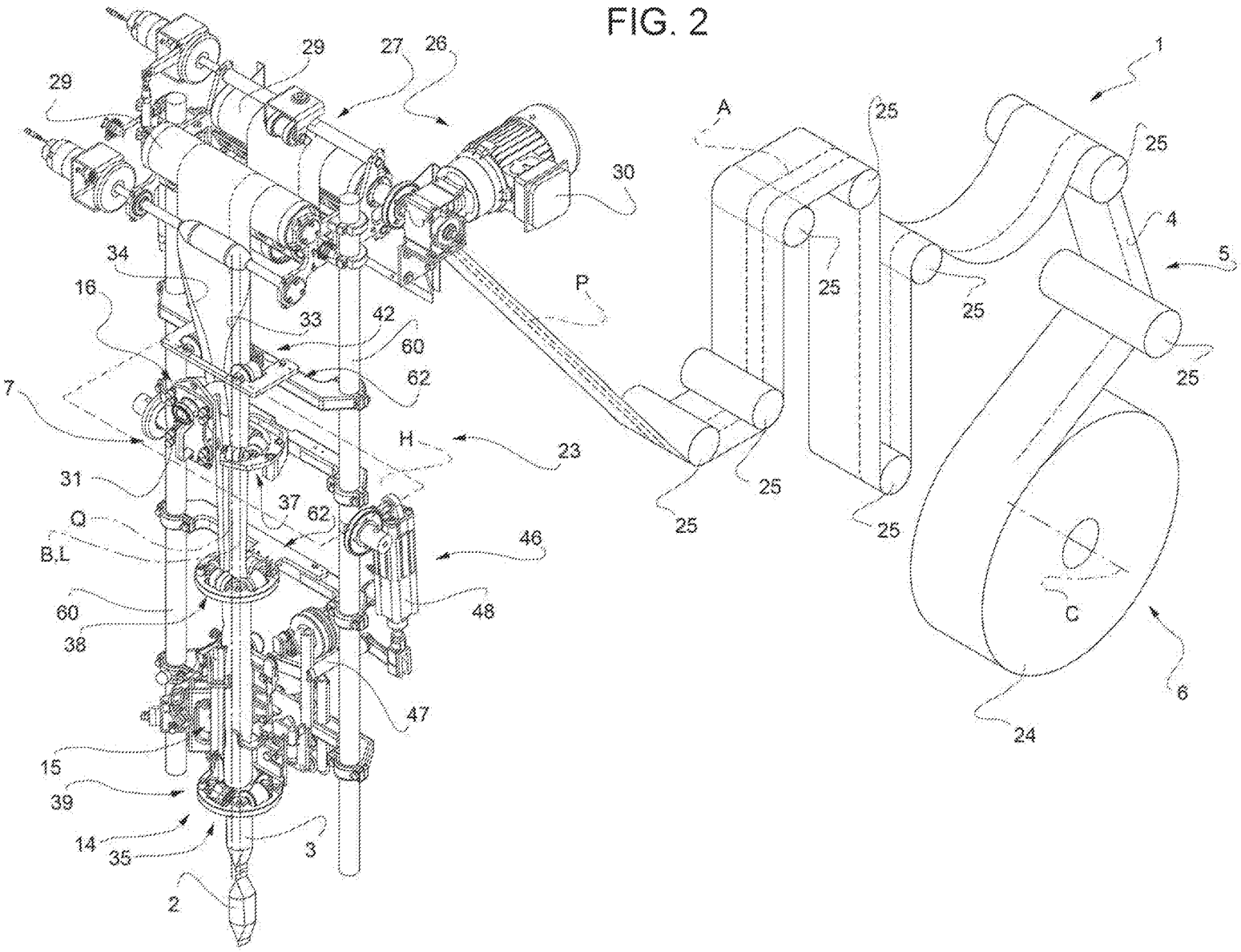
FIG. 2 is a schematic view of some details of the packaging apparatus of FIG. 1, with parts removed for clarity.

With particular reference to FIG. 2, conveying means 5 are also adapted to advance tube 3 formed by tube forming device 14 along its longitudinal axis B along a respective tube advancement path Q.

Preferentially, conveying means 5 are adapted to advance tube 3 and any intermediate of tube 3 along path Q. In particular, with the wording intermediates of tube 3 any configuration of web 4 is meant prior to obtaining the tube structure and after folding of web 4 by tube forming device 14 has started. In other words, the intermediates of tube 3 are a result of the gradual folding or web 4 so as to obtain tube 3, in particular by overlapping with one another a first longitudinal edge 33 of web 4 and a second longitudinal edge 34 of web 4, opposite to first longitudinal edge 33.

In particular, operation of conveying means 5 and operation of package forming unit 17 are synchronized with one another.

More specifically, conveying means 5 are configured to advance web 4 from a reel 24 positioned at station 6 along path P.

Even more specifically, conveying means 5 comprise a plurality of rollers 25 and a driving unit 26 (only partially shown) adapted to rotate at least reel 24 around a respective rotation axis C.

Conveying means 5 also comprise a web drive assembly, in particular a roller group 27 arranged in the area of an inlet station of isolation chamber 10 upstream of tube forming device 14 along path P. In particular, roller group 27 is adapted to guide, in use, web 4 into isolation chamber 10. In particular, roller group 27 is arranged within isolation chamber 10, even more particular within the inner environment.

More specifically, roller group 27 comprises a plurality of respective rollers 29.

Preferentially, support structure 23 also carries roller group 27.

Driving unit 26 comprises a first electrical motor (not shown) adapted to cooperate with reel 24 for rotating reel 24 around axis C. Preferably, driving unit 26 also comprises at least a second electrical motor 30 adapted to rotate at least one of rollers 29 around a respective rotation axis D.

With particular reference to FIG. 2, filling means 16 comprise a filling tube 31 being in fluid connection with a pourable product storage tank (not shown and known as such) and being partially placed within tube 3 for continuously feeding the pourable product into tube 3. In particular, tube 31 has an L-shaped configuration arranged in such a manner that a linear main tube portion of tube 31 extends within tube 3, even more particular the linear main tube portion extending, in use, parallel to axis B.

In a preferred embodiment, filling tube 31 is supported by housing 11.

Preferentially, package forming unit 17 comprises:

a plurality of operative assemblies (not shown) and a plurality of counter-operative assemblies (not shown) for forming packages 2; and a conveying device (not shown) adapted to advance the operative assemblies and the counter-operative assemblies along respective conveying paths.

In more detail, each operative assembly is adapted to cooperate, in use, with one respective counter-operative assembly for forming a respective package 2 from tube 3. In particular, each operative assembly and the respective counter-operative assembly are adapted to shape, to transversally seal and, preferably, also to transversally cut, tube 3 for forming a respective package 2.

In further detail, each operative assembly and the respective counter-operative assembly are adapted to cooperate with one another for forming a respective package 2 from tube 3 when advancing along a respective operative portion of the respective conveying path. In particular, during advancement along the respective operative portion each operative assembly and the respective counter-operative assembly advance parallel to and in the same direction as tube 3.

In more detail, each operative assembly and the respective counter-operative assembly are configured to contact tube 3 when advancing along the respective operative portion of the respective conveying path. In particular, each operative assembly and the respective counter-operative assembly are configured to start to contact tube 3 at a (fixed) hit position.

Furthermore, each operative assembly and the respective counter-operative assembly comprises:

a respective half-shell adapted to contact tube 3 and to at least partially define the shape of packages 2;

one of a sealing element or a counter-sealing element, adapted to transversally seal tube 3 in a known manner between adjacent packages 2.

In a preferred embodiment, each operative assembly and the respective counter-operative assembly also comprises one of a cutting element or a counter-cutting element for transversally cutting tube 3 between adjacent packages 2.

In particular, each half-shell is adapted to be controlled between a working position and a rest position by means of a driving assembly (not shown). In particular, each half-shell is adapted to be controlled into the working position with the respective operative assembly or the respective counter-operative assembly, in use, advancing along the respective operative portion.

With particular reference to FIGS. 2 and 4 to 6, tube forming device 14 is adapted to form tube 3 from, in use, advancing web 4 by substantially overlapping the two longitudinal edges 33 and 34 of web 4.

In more detail, tube forming device 14 comprises a tube forming group 35 adapted to fold web 4 gradually into tube 3, in particular by overlapping edges 33 and 34 with one another for forming a seam portion (not shown and known as such) of tube 3.

Tube forming group 35 comprises at least two, in the specific case shown three, forming ring assemblies 37, 38 and 39 adapted to fold in cooperation with one another web 4 gradually into tube 3, in particular by overlapping edges 33 and 34 with one another for forming the seam portion of tube 3.

In particular, each one of forming rind assemblies 37, 38 and 39 lies in a respective plane H, I, J, in particular each plane H, I, J having a substantially horizontal orientation.

Even more particular, planes H, I and J are parallel to and spaced apart, from one another. In particular, plane H is arranged above plane I; and plane I is arranged above plane J.

Preferentially, each plane H, I and J is orthogonal to axis L.

Furthermore, forming ring assemblies 37, 38 and 39 arranged coaxial to one another. In particular, forming ring assemblies 37, 38 and 39 define longitudinal axis L of tube forming device 14.

Furthermore, forming ring assembly 37 is arranged upstream of forming ring assemblies 38 and 39 along path Q and forming ring assembly 38 is arranged upstream of forming ring assembly 39 along path Q.

Each one of forming ring assembles 37, 38 and 39 comprises a respective support ring 40 and a plurality of respective bending rollers 41 mounted onto the respective support ring 40. In particular, the respective bending rollers 91 are configured to interact with web 4 and/or tube 3 and/or any intermediates of tube 3 for forming tube 3. Even more particular, the respective bending rollers 41 define respective apertures through which, in use, tube 3 and/or the intermediates of tube 3 advance.

In the specific case shown, the respective support ring 40 of forming ring assembly 37 is interrupted (in other words, it does not show a full ring structure, but only a partial ring structure; in even other words, it has an arc-shaped structure, instead of the annular structure of the other support rings 40 of tube forming assemblies 38 and 39).

Preferentially, tube forming device 14 also comprises a pre-bending assembly 42 adapted to cooperate with tube forming group 35 for gradually forming tube 3.

In particular, pre-bending assembly 42 is arranged upstream of tube forming group 35, even more particular upstream of forming ring assembly 37 along path Q.

More specifically, pre-bending assembly 42 comprises two lateral bending rollers 43 adapted to interact with web 4 for bending web 4 so as to approach edges 33 and 34 towards one another. Even more specifically, each one of bending rollers 43 is configured to contact, in use, web 4 in the proximity of one respective edge 33 and 34 of web 4.

Even more specifically, pre-bending assembly 42 also comprises a frame structure 44 carrying the bending rollers 43. In particular, frame structure 44 defines a respective aperture, in particular having a substantially rectangular cross-section, through which, in use, pre-bent web 4 advances.

In other words, pre-bending assembly 42 is adapted to bend web 4 so as to obtain a first intermediate structure of tube 3 and forming ring assemblies 37, 38 and 39 are adapted to interact with web 4 or the intermediates of tube 3 so as to gradually form further intermediate of tube 3 until finally obtaining tube 3.

With particular reference to FIGS. 2 and 4 to 6, sealing device 15 comprises a sealing head 45 adapted to interact with tube 3, in particular with the seam portion for longitudinally sealing tube 3. In the particular embodiment disclosed, sealing head 45 is adapted to heat tube 3, in particular the seam portion by means of induction heating. Alternatively, sealing head 45 could be adapted to heat tube 3, in particular the seam portion by means of heated air.

In more detail, sealing head 45 is arranged substantially between ring forming assemblies 38 and 39 (i.e. sealing, head 45 is arranged between planes I and J).

Preferentially, sealing device 15 adapted to control sealing head 45 at least in an operative configuration at which sealing head 45 is arranged in a working position at which, in use, sealing head 45 is adjacent to tube 3, in particular to the seam portion for locally heating tube 3, in particular for heating the seam portion. Preferably, sealing device 15 is also adapted to control sealing head 45 in a rest configuration at which sealing head 45 is removed from the working position, in particular sealing head 45 being arranged at a rest position. Preferably, in the rest configuration sealing head 45 is deactivated.

More specifically, sealing device 15 comprises an actuation group 46 adapted to set sealing head 45 into the working position or into the rest position.

In particular, actuation group 46 comprises a lever assembly 47 carrying sealing head 45 and an actuator 48 coupled to lever assembly 47 and adapted to actuate movement of lever assembly 47 for controlling sealing head 45 into the working position or into the rest position.

Preferentially, sealing device 15 also comprises a pressuring assembly (only partially shown) adapted to exert a mechanical force on tube 3, in particular on the substantially overlapping edges 33 and 34, even more particular onto the seam portion of tube 3 so as to ensure sealing of tube 3 along the seam portion.

In particular, the pressuring assembly comprises at least an interaction roller 56 and a counter-interaction roller (not shown) adapted to exert the mechanical force onto the seam portion from opposite sides thereof. In particular, in use, the seam portion of tube 3 is interposed between interaction roller 56 and the counter-interaction roller.

Preferentially, the interaction roller 56 is supported by forming ring assembly 39, in particular interaction roller 56 is mounted to the respective support ring 40.

As will be described in more detail further below, support structure 23 also carries at least a portion of sealing device 15, in particular lever assembly 47 and thereby sealing head 45.

Figure 3:
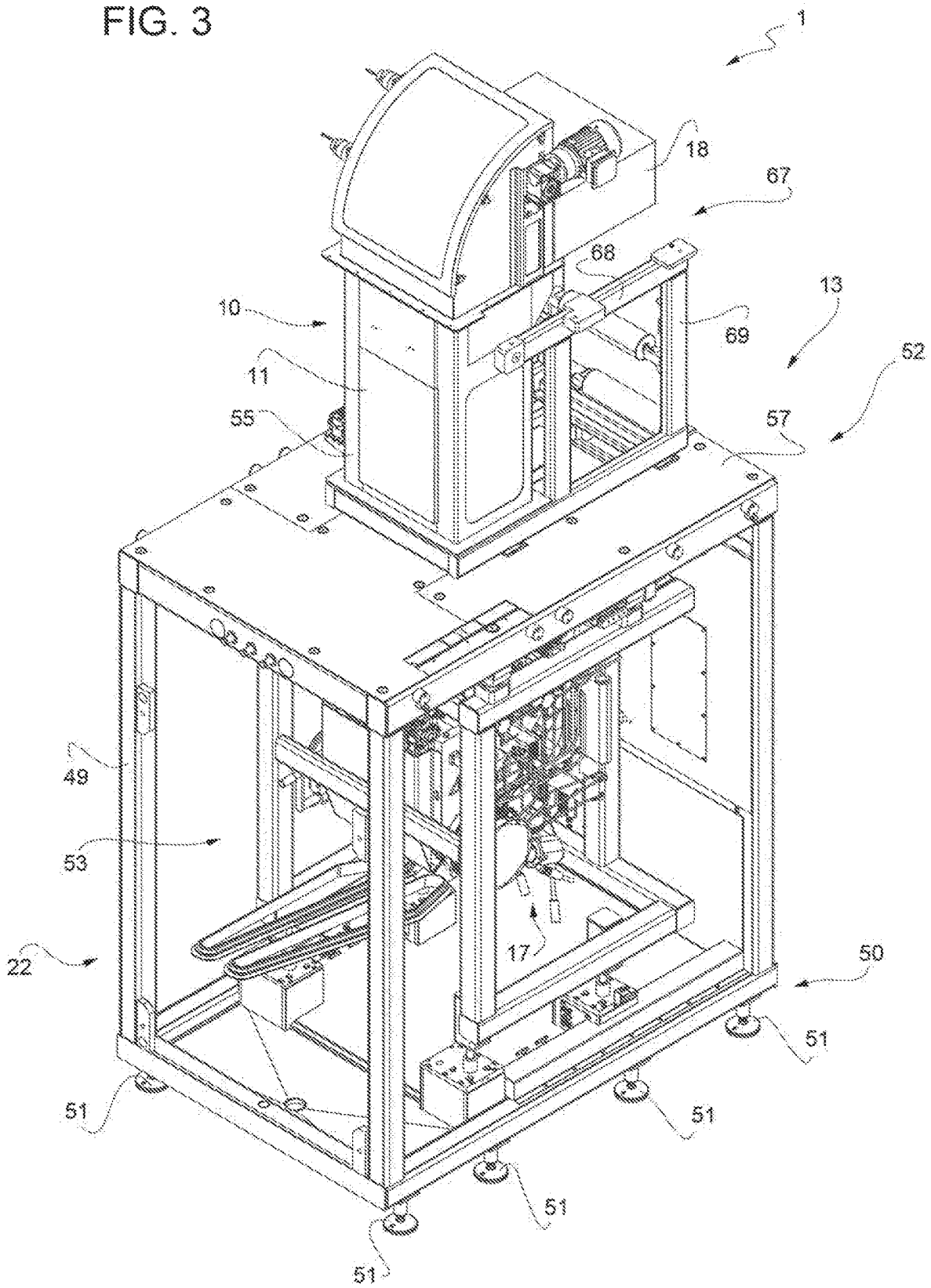
FIG. 3 is an enlarged perspective side view of a detail of the packaging apparatus of FIG. 1, with parts removed for clarity.
Figure 4:
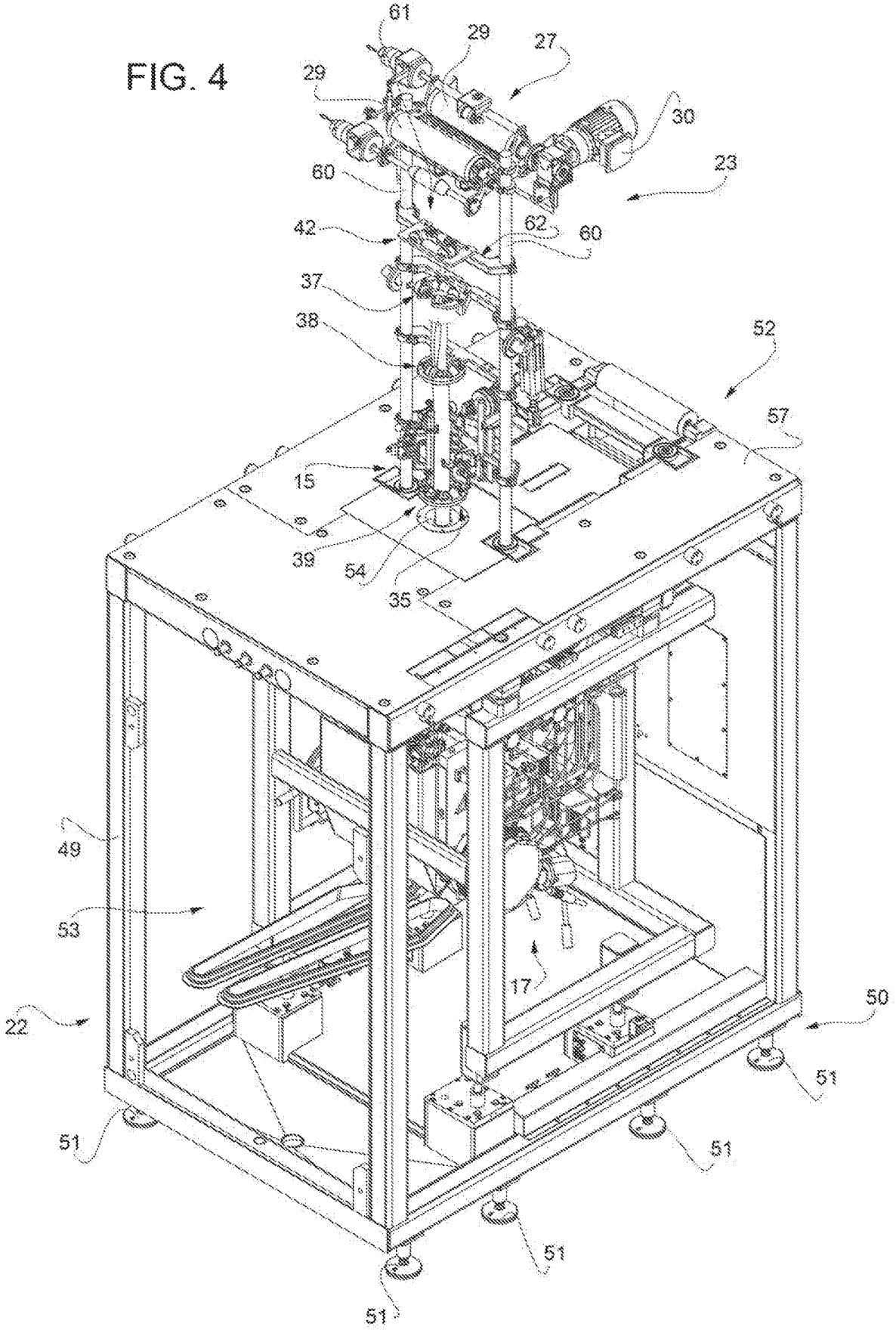
FIG. 4 is a further enlarged perspective side view of the packaging apparatus of FIG. 1, with parts removed for clarity.
Figure 5:
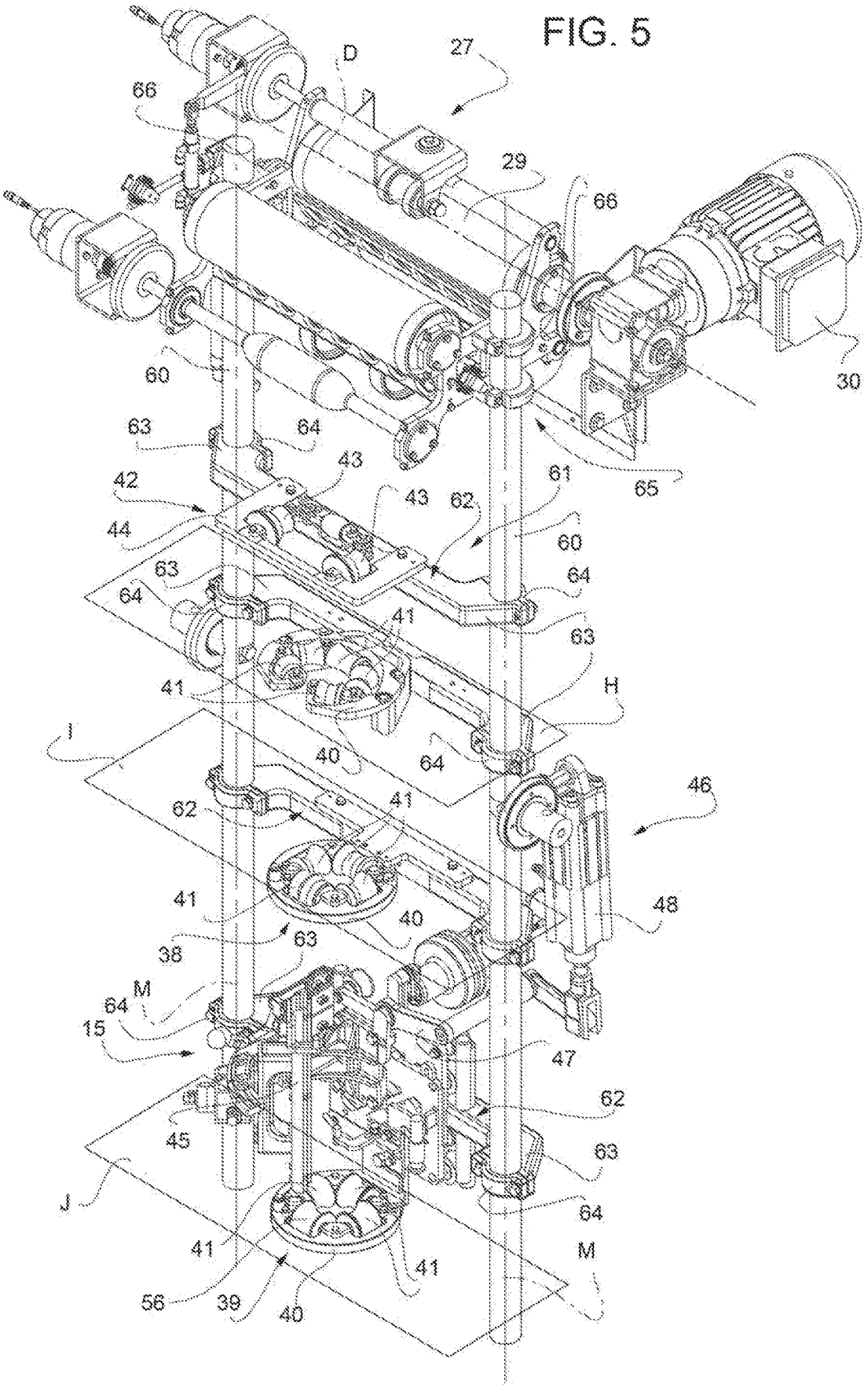
FIG. 5 is an enlarged perspective view of a further detail of the packaging apparatus of FIGS. 1 to 4, with parts removed for clarity.
Figure 6:
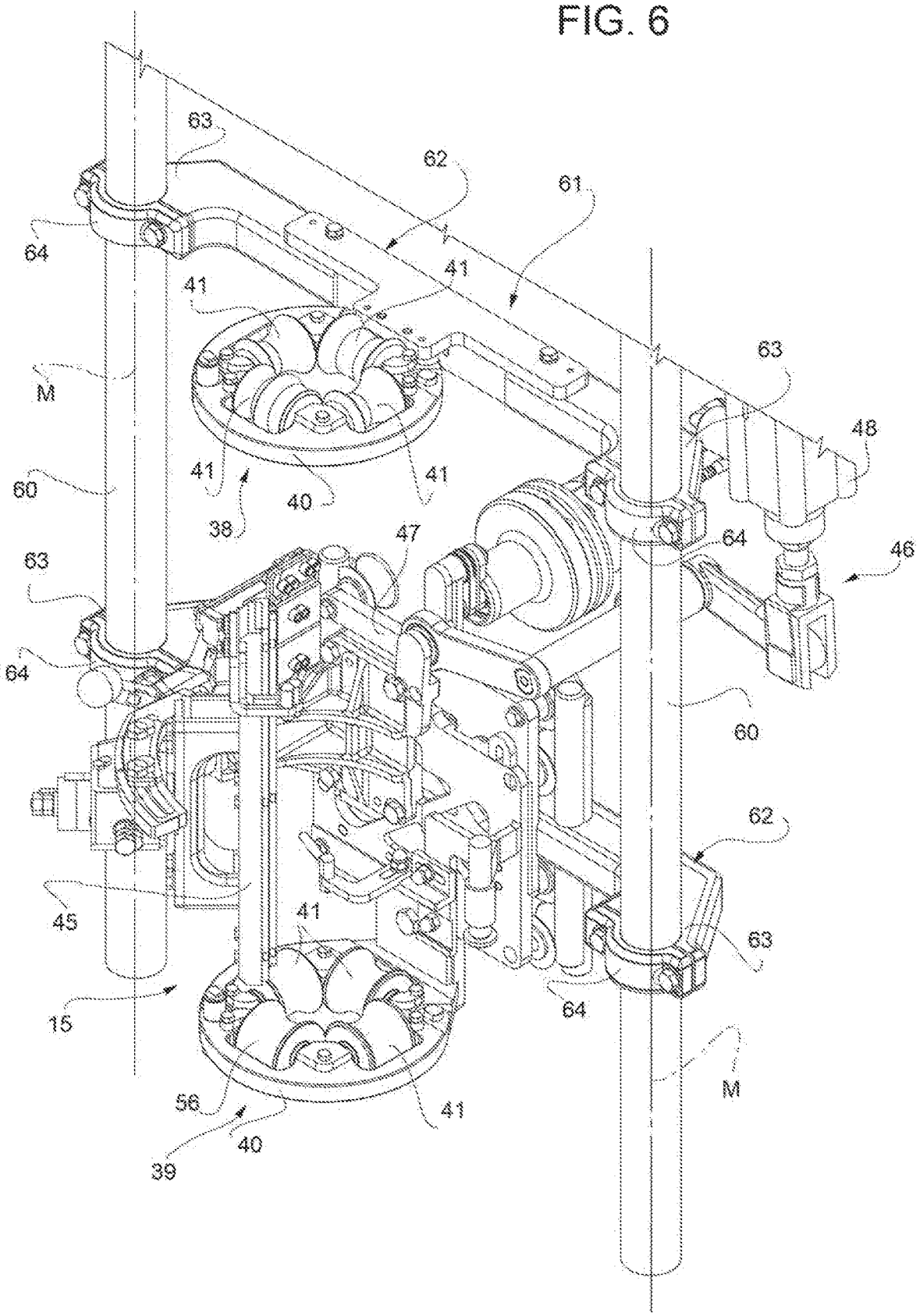
FIG. 6 is an enlarged perspective view of a portion of the further detail of the packaging apparatus of FIG. 5, with parts removed for clarity.

With particular reference to FIGS. 1, 3 and 4, base support structure 22 comprises a main frame structure 49 carrying isolation chamber 10 and support structure 23.

Preferentially, base support structure 22 also comprises an elevation adjustment group 50 adapted to locally adjust elevation of base support structure 22. In particular, elevation adjustment group 50 comprises a plurality of height-adjustable feet elements 51, each one connected to a respective portion of main frame structure 49 and adapted to be placed on a production plant's floor or any other horizontal surface.

Preferably, base support structure 22 also comprises a respective housing 52 (only partially shown) fixed to main frame structure 49 for separating an inner processing environment 53 of base support structure 22 from outer environment 13. Housing 52 comprises a through-hole 54 so as to connect the inner processing environment 53 with the inner environment of the isolation chamber 10 for allowing for advancement of tube 3 from the inner environment of isolation chamber 10 to package forming unit 17.

With particular reference to FIGS. 1, 3 and 4, apparatus 1, in particular base support structure 22, even more particular housing 52, comprises a support platform 57, in particular an upper support plate, even more particular a rigid upper support plate.

According to the non-limiting example embodiment shown in FIGS. 1, 3 and 4, support platform 57 is constructed from a plurality of platform pieces.

According to another non-limiting embodiment not shown, support platform 57 can be realized as a single piece.

Preferably, support platform 57 is horizontally arranged. Even more preferably, feet elements 51 are configured to control the orientation of support platform 57, in particular such that support platform 57 is horizontally oriented.

In particular, support platform 57 fixed to an upper portion of main frame structure 49.

Preferentially, support platform 57 carries through-hole 54 configured to enable the passage of tube 3 from the inner environment of isolation chamber 10 to package forming unit 17, in particular so that the operative assemblies and the respective counter-operative assemblies are able to interact with tube 3 for forming packages 2.

In more detail, support platform 57 supports isolation chamber 10 from a first side of support platform 57 and carries package forming unit 17 from a second side of support platform 57 opposite to the first side.

In particular, support platform 57 is interposed between isolation chamber 10 and package forming unit 17, in particular with isolation chamber 10 being arranged above package forming unit 17.

Preferentially, isolation chamber 10 and package forming unit 17 are removably connected to support platform 57.

In further detail, support platform 57 comprises a plurality of anchorage elements, preferably non-removably fixed to the second side of the support platform 57, to which package forming unit 17 is attached, in particular removably attached.

Preferentially, package forming unit 17 comprises a plurality of engagement elements each one removably attached to one respective anchorage element.

In a preferred embodiment, the anchorage elements and, preferably, also the respective engagement elements, are arranged such that package forming unit 17 carried by support platform 17 is aligned, in particular centered, with respect to through-hole 54 and, preferably, also with respect to tube forming device 14.

In particular, the anchorage elements and, preferably also the corresponding engagement elements, are arranged such that package forming unit 17 is positioned in such a manner that tube 3 advancing along path Q is centered with respect to the operative assemblies and the respective counter-operative assemblies, in particular when the operative assemblies and the respective counter-operative assemblies advance along the respective operative portion of the respective conveying path. In this way, it is guaranteed that the operative assemblies and the respective counter-operative assemblies start to simultaneously engage with tube 3 at the respective hit position.

Preferably, the anchorage elements and, preferably also the respective engagement elements, are arranged such that during a format change during which the package forming unit 17 installed is exchanged with a new package forming unit 17 of a type different from the one of the package forming unit 17 installed is aligned, in particular centered, with respect to through-hole 54.

Even more specifically, during a format change during which the package forming unit 17 installed is exchanged with a new package forming unit 17 of a type different from the one of the package forming unit 17 installed is directly aligned, in particular directly centered, with respect to through-hole 54. In other words, the newly installed package forming unit 17 is aligned, in particular centered with respect to through-hole 54 without the need of any further and lengthy adjustment works. In even other words, the newly installed package forming unit 17 is aligned, in particular centered, with respect to through-hole 54 such that tube 3 advancing along path Q is centered with respect to the operative assemblies (the ones of the newly installed package forming unit 17) and the respective counter-operative assemblies (the ones of the newly installed package forming unit 17), in particular when the operative assemblies and the respective counter-operative assemblies advance along the respective operative portion of the respective conveying path, without the need of lengthy interventions of a technical operator.

In particular, after the exchange of the package forming unit 17 the hit position of the operative assemblies and the respective counter-operative assemblies is automatically adapted to the new package format to be produced.

With particular reference to FIGS. 1 and 3, isolation chamber 10 comprises an auxiliary frame 55 carried by base support structure 22. In particular, auxiliary frame 55 is carried be support platform 57.

Preferentially, auxiliary frame 55 is connected to housing 11. In particular, auxiliary frame 55 removably carries housing 11.

In an alternative embodiment not shown, auxiliary frame 55 comprises a base frame module and at least one extension frame module removably mounted to the base frame module so as to make it possible to change the extension of isolation chamber 10, as will be better explained in the following.

Furthermore, sterilizing unit 18 is designed to sterilize web 4 at the sterilization station by means of an electron beam directed onto web 4. In particular, sterilizing unit 18 comprises an electron beam generator (not shown and known as such) adapted to direct an electron beam onto the, in use, advancing web 4 at the sterilization station. In particular, sterilizing unit 18 is adapted to sterilize web 4 prior to interaction of web 4 with tube forming device 14.

More specifically, sterilizing unit 18 is connected isolation chamber 10. Even more specifically, sterilizing unit 18 is connected to housing 11 of sterilizing unit 18 and is adapted to direct the electron beam through an opening, within housing 11 onto the, in use, advancing web 4.

Alternatively, the sterilizing unit could sterilize web 4 by means of a chemical sterilizing agent, in particular hydrogen peroxide, even more particular by heated hydrogen peroxide.

With particular reference to FIGS. 2 and 4 to 6, support structure 23 comprises at least one support column, preferably at least two support columns 60 (in the specific example shown two support columns 60), carrying at least indirectly a portion or parts, preferentially all parts of tube forming device 14.

Support columns 60 carry at least indirectly tube forming device 14 means that at least one support column 60, preferentially two support columns 60, structurally support tube forming device 14. In other words, the force needed to arrange and to keep tube forming device 14 within isolation chamber 10 is provided by support columns 60; i.e. no other portions of e.g. the isolation chamber 10 provide for a significant structural role for keeping at least tube forming device 14 in place and to precisely arrange it within isolation chamber 10.

In particular, each support column 60 extends along a respective axis M. Preferentially, support columns 60 are also parallel to one another (i.e. the respective axes M are parallel to one another). Even more particular, support columns 60 extend into a vertical direction. Preferably, axis L is parallel to axes M.

In the specific embodiment disclosed, support columns 60 have substantially equal cross-sectional sizes. In particular, each support column 60 has a substantially constant cross-sectional size.

In an alternative embodiment not shown, each support column 60 comprises at least one extension column removably fixed to the respective support column 60 so as to modify the length of the respective support column 60 itself. As it will be described in more detail further below, this is in particular advantageous during a package format change.

Preferentially, support columns 60 are supported by/carried by (and removably mounted to) base support structure 22 and extend perpendicularly away from base support structure 22. Even more particular, support columns 60 are at least indirectly carried by main frame structure 49. Preferentially, support columns 60 are removably mounted to support platform 57. In other words, support columns 60 are removably fixed to base support structure 22.

In more detail, support columns 60 are arranged at least partially within isolation chamber 10, in particular being placed at least partially within the inner environment of the isolation chamber 10. In the example shown, support columns 60 are fully arranged within isolation chamber 10, in particular within the inner environment of the isolation chamber 10.

In particular, support columns 60 are distinct from isolation chamber 10 (i.e. support columns 60 do not define isolation chamber 10). Even more particular, support columns 60 are distinct from auxiliary frame 55 and housing 11.

Preferentially, support columns 60 carry, in particular indirectly carry, at least tube forming group 35. Even more preferentially, support columns 60 also carry, in particular indirectly carry, pre-bending assembly 42.

Preferably, support columns 60 also at least partially carry, in particular indirectly carry, sealing device 15. Even more preferably, support columns 60 indirectly carry at least sealing head 45; and carry at least a portion of actuation group 46, in particular lever assembly 47.

Advantageously, but not necessarily support columns 60 also carry roller group 27, in particular each one of rollers 29.

In further detail, support structure 23 also comprises a coupling assembly 61 coupled to at least support columns 60. In particular, coupling assembly 61 is connected to support columns 60. In this way, coupling assembly 61 is also adapted to increase the mechanical stability of support columns 60 (i.e., coupling assembly 61 further contributes to that vibrations resulting from the operation of apparatus 1 do not significantly influence the arrangement and position of support columns 60). In other words, as will be even more clearer from the following description, coupling assembly 61 is adapted to ensure that the precise positioning of tube forming assembly 14 is maintained during operation of apparatus 1.

Preferably, coupling assembly 61 is also coupled to tube forming device 14 such that support columns 60) indirectly carry tube forming device 14. In particular, tube forming device 14 is coupled to coupling assembly 61 in such a manner that tube forming device 14 is centered with respect to support columns 60. In other words, coupling assembly 61 is connected to support columns 60 and to at least tube forming device 14. Or in even other words, tube forming device 14 is indirectly connected to support columns 60 by coupling assembly 61.

Preferably, coupling assembly 61 is also coupled to, in particular connected to, a portion of sealing device 15, in particular a portion of actuation group 46, even more particular to lever assembly 47 such that support columns 60 indirectly carry the portion of sealing device 15, in particular lever assembly 47.

With particular reference to FIGS. 2 and 4 to 6, coupling assembly 61 comprises a plurality of connection bars 62 each one connected to support columns 60. In particular, each connection bar 62 is arranged transversally to support columns 60.

Preferably, connection bars 62 are connected to at least tube forming group 35, in particular for carrying tube forming group 35.

Preferentially, at least one connection bar 62 is connected to pre-bending assembly 42. In particular, pre-bending assembly 42 is mounted to the respective connection bar 62. Even more particular, frame support 44 is mounted to the respective connection bar 62.

In more detail, each forming ring assembly 37, 38 and 39 is mounted, in particular removably mounted, to one respective connection bar 62. Thus, in the specific example shown, three connection bars 62 are provided for carrying forming ring assemblies 37, 38 and 39.

In even more detail, each respective support ring 40 is removably mounted to the respective connection bar 62.

Furthermore, one connection bar 62, in particular the one carrying forming ring assembly 39, also carries at least a portion of sealing device 15, in particular a portion of actuation group 46, even more particular lever assembly 47. Preferentially, a portion of actuation group 46, in particular actuator 48, is also directly connected to (mounted to) at least one support column 60.

In more detail, each connection bar 62 is fixed, in particular removably fixed to support columns 60 at a respective end portion 63 of the connection bar 62 itself. In particular, each connection bar 62 comprises at least two respective fixing elements 64 for fixing end portions 63 to the respective support columns 60.

Preferably, each connection bar 62 is moveable along support columns 60. In other words, each connection bar 62 is adapted to be displaced along a direction parallel to axis M for arranging the relative positions between connection bars 62 themselves (and the relative positions of forming ring assemblies 37, 38 and 39 and pre-bending assembly 42 with one another).

In particular, each connection bar 62 is adapted to be moved (e.g. by a technician) along the direction parallel to axis M by loosening the respective fixing elements 64 and by applying the respective displacement force. Even more particular, each end portion 63 is moveable along the respective support column 60 by loosening the respective fixing element 64 and applying the respective displacement force.

Preferentially, roller group 27 comprises a carrier structure 65 rotatably carrying rollers 29 and being removably connected to support columns 60. In particular, carrier structure 65 comprises externally arranged connection elements 66 and each one detachably connected to one respective support column 60.

With particular reference to FIGS. 1 and 3, support structure 23 further comprises a stabilizing assembly 67 for further increasing the mechanical stability of support columns (i.e. stabilizing assembly 67 further contributes to that vibrations resulting from the operation of apparatus 1 do not significantly influence the arrangement and position of support columns 60; in other words, stabilizing assembly 67 is adapted to ensure that the precise positioning of tube forming assembly 14 is maintained during operation of apparatus 1).

More specifically, stabilizing assembly 67 comprises at least one main support bar 68 being connected to at least one support column 60. Preferentially, stabilizing assembly 67 comprises at least two main support bars 68 (only one shown in FIG. 2) each one being connected to one respective support column 60.

Furthermore, each main support bar 68 is at least indirectly carried by base support structure 22.

In particular, each main support bar 68 has an extension and orientation transversal, in particular orthogonal to support columns 60. Even more particular, each main support bar 68 has a substantially horizontal orientation.

Preferably, stabilizing assembly 67 also comprises a plurality of auxiliary support bars 69 for supporting main support bars 68. In particular, auxiliary support bars 69 connect main support bars 68 to base support structure 22. Auxiliary support bars 69 are supported by base support structure 22 and are substantially parallel to support columns 60 (i.e. parallel to axes M). In particular, auxiliary support bars 69 are mounted to housing 52, in particular to support platform 57.

In use, conveying means 5 advance web 4 along path P. During advancement of web 4 along path P web 4 is sterilized at the sterilization station by sterilizing unit 18, in particular by irradiating web 4 with an electron beam.

After that web 4 is further advanced to station 7 so that tube forming device 14 forms tube 3 from web 4. The conveying means 5 further advance tube and its intermediates along path Q.

In particular, tube forming device 14, in particular forming ring assemblies 37, 38 and 39 and pre-bending assembly 42, gradually lead to the formation of tube 3, in particular by substantially overlapping edges 33 and 34 for obtaining the seam portion.

Then, sealing device 15 heats the seam portion and forming ring assembly 39 exerts a mechanical force onto the seam portion so as to longitudinally seal tube 3.

During advancement of tube 3, filling means 16 continuously fill tube 3 with the pourable product. Then, package forming unit 17 transversally seals tube 3 and forms packages 2.

A format change of packaging apparatus 1 is possible by replacing tube forming group 35 and by exchanging package forming unit 17.

In particular, when a minor format change occurs (e.g. from one type of package to another type of package, the two types of package having similar volumes) replacing tube forming group 35 requires removal of housing 11 and replacement of forming ring assemblies 37, 38 and 39 with the respective forming ring assemblies 37, 38 and 39 and pre-bending assembly 42 adapted for the new format.

Replacement of these parts can be performed by dismounting them from the respective connection bars 62 or by removing them together with the respective connection bars 62 and by replacing these components with new connection bars 62 which already carry the respective forming ring assemblies 37, 38 and 39 and the respective pre-bending assembly 42. The correct alignment of forming ring assemblies 37, 38 and 39 and the pre-bending assembly 42 can be done by moving the connection bars 62 parallel to axes M.

When a major format change is needed (e.g. from one type of package to another type of package, the two types of package having significantly differing volumes) with respect to the minor format change it is also necessary no obtain longer or shorter support columns 60.

In the case longer support columns 60 are required, it is also necessary to mount the respective extension columns to the support columns 60 as present.

As well, it becomes necessary to modify isolation chamber 10 so that support columns 60 remain within isolation chamber 10. This is done by adding an extension frame module to the base frame module of auxiliary frame 55 extending thereby the extension of isolation chamber 10. As well, housing 11 must be adapted to the extended auxiliary frame structure 55.

In the case shorter support columns 60 are required, it is also necessary to remove the respective extension frame module (s) of the auxiliary frame structure 55 and to remove the respective extension columns of support columns 60.

Preferentially, the exchange of package forming unit 17 requires to remove the package forming unit 17 in use from support platform 57, in particular from the anchorage elements.

More specifically, the engagement element of package forming unit 17 are detached from the respective anchorage elements.

Then, the new package forming unit 17 is attached to support platform 57, in particular to the anchorage elements.

More specifically, the engagement elements are attached to the respective anchorage elements.

The advantages of packaging apparatus 1 according to the present invention will be clear from the foregoing description.

In particular, using at least one support column 60 or preferably at least two support columns 60 for carrying at least indirectly the tube forming device 14 increases the flexibility and accuracy of packaging apparatus 1.

A further advantage is that the use of support columns 60 for structurally carrying at least tube forming device 14 allows to provide for a self-centering of the tube forming device 14. Thus, the alignment of the parts (the ring forming assemblies 37, 38, 39) of the tube forming device 14 is facilitated with respect to the packaging apparatuses known in the art in which the tube forming device 14 is carried by the housing of the isolation chamber. This provides for decreased downtimes during e.g. a format change.

An even other advantage is that support columns 60 can be arranged on base support structure 22 with a high accuracy. This again leads to an improved alignment of the forming ring assemblies 37, 38 and 39 and the pre-bending assembly 42 in comparison to mounting these to the housing of the isolation chamber of a packaging apparatus.

Another advantage is that support columns 60 also carry other parts (e.g. sealing head 45, lever assembly 47, roller group 27) arranged within isolation chamber 10.

An additional advantage is that the housing 11 does not have a structural function. This allows to increase the possible choice of materials adapted for housing 11 and less material can be used. This allows to reduce the size of the isolation chamber, to decrease the weight of the overall structure and to facilitate the exchange of housing 11 or parts of housing 11 if needed (e.g. due a format change).

An even further advantage resides in package forming unit 17 being removably attached to support platform 57, which allows a rapid exchange of package forming unit 17 with a new package forming unit 17.

An even additional advantage is that the anchorage elements allow to precisely align, in particular center, package forming unit 17 with respect to through-hole 54, in particular without the need of any extensive (and time consuming) interventions by a technical operator.

Clearly, changes may be made to packaging apparatus 1 as described herein without, however, departing from the scope of protection as defined in the accompanying claims.

In an alternative embodiment not shown, the support columns of support structure 23 could be of the extendable type so as to change the length of the support columns (e.g. as required by a format change).

In a further embodiment not shown, the support columns of support structure 23 could be of the modular type. In particular, support columns could comprise varying column portions, each one removably fixed to at least one adjacent column portion.

In an even further embodiment not shown, the support columns of support structure 23 could have varying cross-sectional sizes. In particular, the support columns could have a truncated cone-shape.

The invention claimed is:

1. A packaging apparatus for forming a plurality of sealed packages filled with a pourable product comprising:

conveying means for advancing a web of packaging material along an advancement path;

an isolation chamber separating an inner environment from an outer environment;

a tube forming device extending along a longitudinal axis, being at least partially arranged within the isolation chamber and being configured to form a tube from the, in use, advancing web of packaging material, wherein the conveying means are also configured to advance the tube formed by the tube forming device along a respective tube advancement path;

a sealing device at least partially arranged within the isolation chamber and being configured to longitudinally seal the tube formed by the tube forming device;

a support structure carrying at least the tube forming device;

filling means for continuously filling the tube formed by the tube forming device with a pourable product;

a package forming unit configured to form and seal the packages from the, in use, advancing tube formed by the tube forming device and filled by the filling means;

a base support structure housing the package forming unit, the isolation chamber being supported on the base support structure;

the support structure comprising at least one support column supported on the base support structure and extending perpendicularly away from the base support structure, the at least one support column being arranged within the isolation chamber, the at least one support column carrying at least indirectly the tube forming device and extending parallel to the longitudinal axis of the tube forming device.

2. The packaging apparatus according to claim 1, wherein the base support structure comprises a main frame structure and the isolation chamber comprises an auxiliary frame carried by the main frame structure.

3. The packaging apparatus according to claim 2, wherein the isolation chamber comprises a housing connected to the auxiliary frame and the support column is distinct from the auxiliary frame and the housing.

4. The packaging apparatus according to claim 1, wherein the support structure also comprises a coupling assembly coupled to the support column and to the tube forming device such that the support column indirectly carries the tube forming device.

5. The packaging apparatus according to claim 4, wherein the support structure comprises plural support columns that are parallel to one another, wherein the coupling assembly is coupled to at least a pair of the support columns.

6. The packaging apparatus according to claim 5, wherein the tube forming device is centered with respect to the pair of the support columns coupled to one another by the coupling assembly.

7. The packaging apparatus according to claim 1, wherein the support structure further comprises a stabilizing assembly for mechanically stabilizing the support column.

8. The packaging apparatus according to claim 7, wherein the stabilizing assembly comprises at least one main support bar connected to the support column, having an extension transversal to the support column and being at least indirectly carried by a base support structure of the packaging apparatus.

9. The packaging apparatus according to claim 1, wherein the support column also carries at least a portion of the sealing device.

10. The packaging apparatus according to claim 1, and further comprising a sterilization unit configured to sterilize the web of packaging material at a sterilization station upstream of the tube forming device along the advancement path.

11. The packaging apparatus according to claim 10, wherein the sterilizing unit comprises an electron beam generator configured to direct an electron beam onto the, in use, advancing web of packaging material.

12. The packaging apparatus according to claim 1, wherein the tube forming device comprises at least two forming ring assemblies, each of which extends within a respective plane, wherein the respective planes are parallel and spaced apart from one another.

13. The packaging apparatus according to claim 12, wherein each one of the forming ring assemblies is connected to at least a respective connection bar, the respective connection bar being connected to the support column.

14. The packaging apparatus according to claim 13, wherein each connection bar is moveable along the support column.

15. The packaging apparatus according to claim 1, wherein the conveying means comprises a web drive assembly arranged within the isolation chamber upstream of the tube forming device along the advancement path, the web drive assembly being carried by the support column.

16. A packaging apparatus for forming a plurality of sealed packages filled with a pourable product comprising:

conveying means for advancing a web of packaging material along an advancement path;

an isolation chamber separating an inner environment from an outer environment;

a tube forming device extending along a longitudinal axis, being at least partially arranged within the isolation chamber and being configured to form a tube from the, in use, advancing web of packaging material, wherein the conveying means are also configured to advance the tube formed by the tube forming device along a respective tube advancement path;

a sealing device at least partially arranged within the isolation chamber and being adapted to longitudinally seal the tube formed by the tube forming device, the sealing device including a sealing head configured to heat the tube;

filling means for continuously filling the tube formed by the tube forming device with a pourable product;

a package forming unit configured to form and seal the packages from the, in use, advancing tube formed by the tube forming device and filled by the filling means;

a base support structure housing the package forming unit, the base support structure including a support platform, the isolation chamber being supported on the support platform of the base support structure and extending away from the other side of the support platform; and at least one support column removably mounted to the support platform of the base support structure and extending perpendicularly away from the support platform of the base support structure, the at least one support column being arranged within the isolation chamber, the at least one support column carrying at least indirectly the tube forming device and extending parallel to the longitudinal axis of the tube forming device.

17. The packaging apparatus according to claim 16, wherein the isolation chamber includes a frame that is removably mounted on the support platform of the base support structure.

18. The packaging apparatus according to claim 16, wherein the tube forming device includes a plurality of forming ring assemblies spaced apart from one another within the isolation chamber and each mounted on a respective connection bar, each of the connection bars being mounted on the at least one support column and being spaced apart from one another, each of the ring assemblies being removably mounted on the respective connection bar and/or each of the connection bars being removably mounted on the at least one support column.

19. A packaging apparatus for forming a plurality of sealed packages filled with a pourable product comprising:

conveying means for advancing a web of packaging material along an advancement path;

an isolation chamber separating an inner environment from an outer environment;

a tube forming device extending along a longitudinal axis, being at least partially arranged within the isolation chamber and being configured to form a tube from the, in use, advancing web of packaging material, wherein the conveying means are also configured to advance the tube formed by the tube forming device along a respective tube advancement path;

a sealing device at least partially arranged within the isolation chamber and being adapted to longitudinally seal the tube formed by the tube forming device, the sealing device including a sealing head arranged within the isolation chamber and configured to heat the tube;

filling means for continuously filling the tube formed by the tube forming device with a pourable product;

a package forming unit configured to form and seal the packages from the, in use, advancing tube formed by the tube forming device and filled by the filling means;

a base support structure housing the package forming unit, the base support structure including a support platform, the isolation chamber being supported on the support platform of the base support structure and extending away from the other side of the support platform;

at least one support column supported on the support platform of the base support structure and extending perpendicularly away from the support platform of the base support structure, the at least one support column being arranged within the isolation chamber;

the at least one support column carrying at least indirectly the tube forming device and extending parallel to the longitudinal axis of the tube forming device; and the at least one support column carrying at least indirectly the sealing head.

20. The packaging apparatus according to claim 19, wherein the tube forming device includes at least two forming ring assemblies spaced apart from one another within the isolation chamber, the sealing head being positioned between the at least two forming ring assemblies.

* * * * *